US007713088B2

(12) United States Patent
Sercu et al.

(10) Patent No.: US 7,713,088 B2
(45) **Date of Patent: *May 11, 2010**

(54) BROADSIDE-COUPLED SIGNAL PAIR CONFIGURATIONS FOR ELECTRICAL CONNECTORS

(75) Inventors: Stefaan Hendrik Jozef Sercu, Brasschaat (BE); Jan De Geest, Wetteren (BE)

(73) Assignee: FCI, Versailles (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/866,061

(22) Filed: Oct. 2, 2007

(65) Prior Publication Data

US 2008/0085618 A1 Apr. 10, 2008

Related U.S. Application Data

(60) Provisional application No. 60/849,535, filed on Oct. 5, 2006.

(51) Int. Cl.
*H01R 13/648* (2006.01)

(52) U.S. Cl. ..... 439/607.1

(58) Field of Classification Search ..... 439/608, 439/108, 607, 607.1

See application file for complete search history.

(56) References Cited

U.S. PATENT DOCUMENTS 3,286,220 A 11/1966 Marley et al.
3,390,369 A 6/1968 Zavertnik et al.
3,538,486 A 11/1970 Shlesinger Jr.
3,587,028 A 6/1971 Uberbacher
3,669,054 A 6/1972 Desso et al.
3,748,633 A 7/1973 Lundergan
4,045,105 A 8/1977 Lee et al.
4,076,362 A 2/1978 Ichimura
4,159,861 A 7/1979 Anhalt
4,260,212 A 4/1981 Ritchie et al.
4,288,139 A 9/1981 Cobaugh et al.

(Continued)

FOREIGN PATENT DOCUMENTS

EP 0273683 A2 7/1988

(Continued)

OTHER PUBLICATIONS

"Mezzanine High-Speed High-Density Connectors", Gig-Array™ and MEG-Array® Connectors, Electrical Performance Data, www.fciconnect.com, 39 pages.

(Continued)

*Primary Examiner*—Neil Abrams
*Assistant Examiner*—Phuong Nguyen
(74) *Attorney, Agent, or Firm*—Woodcock Washburn LLP

(57) ABSTRACT

An electrical connector having a first electrical contact and a second electrical contact adjacent to the first electrical contact. The first electrical contact may define a first broadside and a second broadside opposite the first broadside. The second electrical contact may define a third broadside and a fourth broadside opposite the third broadside. The electrical connector may further include a non-air dielectric and a commoned ground plate. The non-air dielectric may be disposed between the second broadside of the first electrical contact and the fourth broadside of the second electrical contact. The commoned ground plate and the first electrical contact may be adjacent to one another and may be separated by an air dielectric.

23 Claims, 9 Drawing Sheets

U.S. PATENT DOCUMENTS

| | | | | |
|---|---|---|---|---|
| 4,383,724 | A | 5/1983 | Verhoeven | |
| 4,402,563 | A | 9/1983 | Sinclair | |
| 4,482,937 | A | 11/1984 | Berg | |
| 4,560,222 | A | 12/1985 | Dambach | |
| 4,717,360 | A | 1/1988 | Czaja | |
| 4,734,060 | A | 3/1988 | Kawawada et al. | |
| 4,776,803 | A | 10/1988 | Pretchel et al. | |
| 4,815,987 | A | 3/1989 | Kawano et al. | |
| 4,867,713 | A | 9/1989 | Ozu et al. | |
| 4,907,990 | A | 3/1990 | Bertho et al. | |
| 4,913,664 | A | 4/1990 | Dixon | |
| 4,973,271 | A | 11/1990 | Ishizuka et al. | |
| 5,066,236 | A | 11/1991 | Broeksteeg | |
| 5,077,893 | A | 1/1992 | Mosquera et al. | |
| 5,098,311 | A | 3/1992 | Roath et al. | |
| 5,163,849 | A | 11/1992 | Fogg et al. | |
| 5,167,528 | A | 12/1992 | Nishiyama et al. | |
| 5,174,770 | A | 12/1992 | Sasaki et al. | |
| 5,192,231 | A | 3/1993 | Dolin, Jr. | |
| 5,224,867 | A | 7/1993 | Ohtsuki et al. | |
| 5,238,414 | A | 8/1993 | Yaegashi et al. | |
| 5,254,012 | A | 10/1993 | Wang | |
| 5,274,918 | A | 1/1994 | Reed | |
| 5,277,624 | A | 1/1994 | Champion et al. | |
| 5,286,212 | A | 2/1994 | Broeksteeg | |
| 5,302,135 | A | 4/1994 | Lee | |
| 5,342,211 | A | 8/1994 | Broeksteeg | |
| 5,356,300 | A | 10/1994 | Costello et al. | |
| 5,356,301 | A | 10/1994 | Champion et al. | |
| 5,357,050 | A | 10/1994 | Baran et al. | |
| 5,431,578 | A | 7/1995 | Wayne | |
| 5,475,922 | A | 12/1995 | Tamura et al. | |
| 5,525,067 | A | 6/1996 | Gatti | |
| 5,558,542 | A | 9/1996 | O'Sullivan et al. | |
| 5,586,914 | A | 12/1996 | Foster, Jr., deceased et al. | |
| 5,590,463 | A | 1/1997 | Feldman et al. | |
| 5,609,502 | A | 3/1997 | Thumma | |
| 5,713,746 | A | 2/1998 | Olson et al. | |
| 5,730,609 | A | 3/1998 | Harwath | |
| 5,741,144 | A | 4/1998 | Elco et al. | |
| 5,741,161 | A | 4/1998 | Cahaly et al. | |
| 5,795,191 | A | 8/1998 | Preputnick et al. | |
| 5,817,973 | A | 10/1998 | Elco et al. | |
| 5,853,797 | A | 12/1998 | Fuchs et al. | |
| 5,908,333 | A | 6/1999 | Perino et al. | |
| 5,925,274 | A | 7/1999 | McKinney et al. | |
| 5,961,355 | A * | 10/1999 | Morlion et al. | 439/686 |
| 5,967,844 | A | 10/1999 | Doutrich et al. | |
| 5,971,817 | A | 10/1999 | Longueville | |
| 5,980,321 | A | 11/1999 | Cohen et al. | |
| 5,993,259 | A | 11/1999 | Stokoe et al. | |
| 6,042,389 | A | 3/2000 | Lemke et al. | |
| 6,050,862 | A | 4/2000 | Ishii | |
| 6,068,520 | A | 5/2000 | Winings et al. | |
| 6,099,332 | A | 8/2000 | Troyan | |
| 6,116,926 | A | 9/2000 | Ortega et al. | |
| 6,116,965 | A | 9/2000 | Arnett et al. | |
| 6,123,554 | A | 9/2000 | Ortega et al. | |
| 6,125,535 | A | 10/2000 | Chiou et al. | |
| 6,129,592 | A | 10/2000 | Mickievicz et al. | |
| 6,139,336 | A | 10/2000 | Olson | |
| 6,146,157 | A | 11/2000 | Lenoir et al. | |
| 6,146,203 | A | 11/2000 | Elco et al. | |
| 6,150,729 | A | 11/2000 | Ghahghahi | |
| 6,171,115 | B1 | 1/2001 | Mickievicz et al. | |
| 6,171,149 | B1 | 1/2001 | van Zanten | |
| 6,190,213 | B1 | 2/2001 | Reichart et al. | |
| 6,212,755 | B1 | 4/2001 | Shimada et al. | |
| 6,219,913 | B1 | 4/2001 | Uchiyama | |
| 6,220,896 | B1 | 4/2001 | Bertoncini et al. | |
| 6,227,882 | B1 | 5/2001 | Ortega et al. | |
| 6,267,604 | B1 | 7/2001 | Mickievicz et al. | |
| 6,269,539 | B1 | 8/2001 | Takahashi et al. | |
| 6,280,209 | B1 | 8/2001 | Bassler et al. | |
| 6,293,827 | B1 | 9/2001 | Stokoe et al. | |
| 6,319,075 | B1 | 11/2001 | Clark et al. | |
| 6,322,379 | B1 | 11/2001 | Ortega et al. | |
| 6,322,393 | B1 | 11/2001 | Doutrich et al. | |
| 6,328,602 | B1 | 12/2001 | Yamasaki et al. | |
| 6,343,955 | B2 | 2/2002 | Billman et al. | |
| 6,347,952 | B1 | 2/2002 | Hasegawa et al. | |
| 6,350,134 | B1 | 2/2002 | Fogg et al. | |
| 6,354,877 | B1 | 3/2002 | Shuey et al. | |
| 6,358,061 | B1 | 3/2002 | Regnier | |
| 6,361,366 | B1 | 3/2002 | Shuey et al. | |
| 6,363,607 | B1 | 4/2002 | Chen et al. | |
| 6,364,710 | B1 | 4/2002 | Billman et al. | |
| 6,368,121 | B1 * | 4/2002 | Ueno et al. | 439/108 |
| 6,371,773 | B1 | 4/2002 | Crofoot et al. | |
| 6,375,478 | B1 | 4/2002 | Kikuchi | |
| 6,379,188 | B1 | 4/2002 | Cohen et al. | |
| 6,386,914 | B1 | 5/2002 | Collins et al. | |
| 6,409,543 | B1 | 6/2002 | Astbury, Jr. et al. | |
| 6,431,914 | B1 | 8/2002 | Billman | |
| 6,435,913 | B1 | 8/2002 | Billman | |
| 6,435,914 | B1 | 8/2002 | Billman | |
| 6,461,202 | B2 | 10/2002 | Kline | |
| 6,471,548 | B2 | 10/2002 | Bertoncini et al. | |
| 6,482,038 | B2 | 11/2002 | Olson | |
| 6,485,330 | B1 | 11/2002 | Doutrich | |
| 6,494,734 | B1 | 12/2002 | Shuey et al. | |
| 6,503,103 | B1 | 1/2003 | Cohen et al. | |
| 6,506,081 | B2 | 1/2003 | Blanchfield et al. | |
| 6,520,803 | B1 | 2/2003 | Dunn | |
| 6,527,587 | B1 | 3/2003 | Ortega et al. | |
| 6,537,111 | B2 | 3/2003 | Brammer et al. | |
| 6,540,559 | B1 | 4/2003 | Kemmick et al. | |
| 6,547,066 | B2 | 4/2003 | Koch | |
| 6,547,606 | B1 | 4/2003 | Johnston et al. | |
| 6,554,647 | B1 | 4/2003 | Cohen et al. | |
| 6,572,410 | B1 | 6/2003 | Volstorf et al. | |
| 6,602,095 | B2 | 8/2003 | Astbury, Jr. et al. | |
| 6,609,933 | B2 | 8/2003 | Yamasaki et al. | |
| 6,641,411 | B1 | 11/2003 | Stoddard et al. | |
| 6,652,318 | B1 | 11/2003 | Winings et al. | |
| 6,652,319 | B1 | 11/2003 | Billman | |
| 6,672,907 | B2 | 1/2004 | Azuma | |
| 6,692,272 | B2 | 2/2004 | Lemke et al. | |
| 6,695,627 | B2 | 2/2004 | Ortega et al. | |
| 6,700,455 | B2 | 3/2004 | Tripathi et al. | |
| 6,717,825 | B2 | 4/2004 | Volstorf | |
| 6,762,067 | B1 | 7/2004 | Quinones et al. | |
| 6,764,341 | B2 | 7/2004 | Lappoehn | |
| 6,776,649 | B2 | 8/2004 | Pape et al. | |
| 6,805,278 | B1 | 10/2004 | Olson et al. | |
| 6,808,399 | B2 | 10/2004 | Rothermel et al. | |
| 6,824,391 | B2 | 11/2004 | Mickievicz et al. | |
| 6,843,686 | B2 | 1/2005 | Ohnishi et al. | |
| 6,848,944 | B2 | 2/2005 | Evans | |
| 6,851,974 | B2 | 2/2005 | Doutrich | |
| 6,852,567 | B1 | 2/2005 | Lee et al. | |
| 6,863,543 | B2 | 3/2005 | Lang et al. | |
| 6,869,292 | B2 | 3/2005 | Johnescu et al. | 439/74 |
| 6,890,214 | B2 | 5/2005 | Brown et al. | |
| 6,905,368 | B2 * | 6/2005 | Mashiyama et al. | 439/608 |
| 6,913,490 | B2 | 7/2005 | Whiteman, Jr. et al. | |
| 6,932,649 | B1 | 8/2005 | Rothermel et al. | |
| 6,945,796 | B2 | 9/2005 | Bassler et al. | |
| 6,953,351 | B2 | 10/2005 | Fromm et al. | |
| 6,969,268 | B2 | 11/2005 | Brunker | |
| 6,969,280 | B2 | 11/2005 | Chien et al. | |
| 6,976,886 | B2 | 12/2005 | Winings et al. | |
| 6,979,226 | B2 | 12/2005 | Otsu et al. | |
| 6,981,883 | B2 * | 1/2006 | Raistrick et al. | 439/74 |

| | | | | |
|---|---|---|---|---|
| 6,988,902 | B2 | 1/2006 | Winings et al. | |
| 6,994,569 | B2 | 2/2006 | Minich et al. | 439/79 |
| 7,057,115 | B2 | 6/2006 | Clink et al. | |
| 7,097,506 | B2 | 8/2006 | Nakada | |
| 7,118,391 | B2 | 10/2006 | Minich et al. | |
| 7,131,870 | B2 | 11/2006 | Whiteman, Jr. et al. | |
| 7,157,250 | B2 | 1/2007 | Gabriel | |
| 7,182,643 | B2 | 2/2007 | Winings | |
| 7,207,807 | B2 | 4/2007 | Fogg | |
| 7,229,318 | B2 | 6/2007 | Winings et al. | |
| 7,320,621 | B2 | 1/2008 | Laurx | |
| 7,331,800 | B2 * | 2/2008 | Winings et al. | 439/79 |
| 7,407,413 | B2 | 8/2008 | Minich | |
| 7,422,484 | B2 | 9/2008 | Cohen et al. | |
| 7,524,209 | B2 | 4/2009 | Hull | |
| 2002/0098727 | A1 | 7/2002 | McNamara et al. | |
| 2002/0106930 | A1 | 8/2002 | Pape et al. | |
| 2003/0143894 | A1 | 7/2003 | Kline et al. | |
| 2003/0171010 | A1 | 9/2003 | Winings et al. | |
| 2003/0203665 | A1 | 10/2003 | Ohnishi et al. | |
| 2003/0220021 | A1 | 11/2003 | Whiteman, Jr. et al. | |
| 2005/0009402 | A1 | 1/2005 | Chien et al. | |
| 2005/0020109 | A1 | 1/2005 | Raistrick et al. | |
| 2005/0118869 | A1 | 6/2005 | Evans | |
| 2005/0170700 | A1 | 8/2005 | Shuey et al. | |
| 2005/0277221 | A1 | 12/2005 | Mongold | |
| 2006/0014433 | A1 | 1/2006 | Consoli | |
| 2006/0046526 | A1 | 3/2006 | Minich | |
| 2006/0121749 | A1 | 6/2006 | Fogg | |
| 2006/0192274 | A1 | 8/2006 | Lee | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0102702 | A1 | 5/2008 | Sercu | |
| 2009/0011641 | A1 | 1/2009 | Cohen et al. | |
| 2009/0191756 | A1 | 7/2009 | Hull | |

FOREIGN PATENT DOCUMENTS

| | | | |
|---|---|---|---|
| EP | 0891016 | | 10/2002 |
| EP | 1148587 | B1 | 4/2005 |
| JP | 06-236788 | | 8/1994 |
| JP | 07-114958 | | 5/1995 |
| JP | 11-185886 | | 7/1999 |
| JP | 2000-003743 | | 1/2000 |
| JP | 2000-003744 | | 1/2000 |
| JP | 2000-003745 | | 1/2000 |
| JP | 2000-003746 | | 1/2000 |
| WO | WO 90/16093 | | 12/1990 |
| WO | WO 01/29931 | A1 | 4/2001 |
| WO | WO 01/39332 | A1 | 5/2001 |
| WO | WO 02/101882 | | 12/2002 |
| WO | WO2006031296 | | 3/2006 |

OTHER PUBLICATIONS

"Gig-Array® Connector System", www.fciconnect.com, 4 pages.
Gig-Array High Speed Mezzanine Connectors, 15-40 mm Board to Board, Set-Up Application Specification, GS-20-016, Jun. 5, 2006, 24 pages.
Perspective View of Gigarray IMLA, 1998, 1 page.
"Fci's Airmax Vs® Connector System Honored at DesignCon", 2005, Heilind Electronics, Inc., http://www.heilind.com/products/fci/airmax-vs-design.asp, 1 page.
"Framatome Connector Specification", 1 page.
"MILLIPACS Connector Type A Specification", 1 page.
"B? Bandwidth and Rise Time Budgets" Module 1-8 Fiber Optic Telecommunications (E-XVI-2a), http://cord.org/step_online/st1-8/stl8exvi2a.htm, 3 pages, date not available.
"Lucent Technologies Bell Labs and FCI Demonstrate 25gb/S Data Transmission over Electrical Backplane Connectors", Feb. 1, 2005, http://www.lucent.com/press/0205/050201.bla.html, 4 pages.
"PCB-Mounted Receptacle Assemblies, 2.00 mm(0.079in) Centerlines, Right-Angle Solder-to-Board Signal Receptacle", Metral™, Berg Electronics, Oct. 6 - Oct. 7, 2 pages.
"Tyco Electronics, Z-Dok and Connector", Tyco Electronics, Jun. 23, 2003, http://Zdok.tyco.elcetronics.com, 15 pages.
4.0 UHD Connector Differential Signal Crosstalk, Reflections, 1998, p. 8-9.
AMP Z-Pack 2mm HM Connector 2 mm Centerline,Eight-Row, Right Angle Applications, Electrical Performance Report, EPR 889065, issued Sep. 1998, 59 pages.
AMP Z-Pack 2mm HM Interconnection System, 1992 and 1994© by Amp Incorporated, 6 pages.
AMP Z-Pack HM-ZD Performance at Gigabit Speeds, Report # 20GC014, May 4, 2001.
Amphenol TCS (ATCS): VHDM Connector, http://www.teradyne.com/prods/tcs/products/connectors/backplane/vhdm/index.html, 2 pages.
Amphenol TCS (ATCS):HDM® Stacker Signal Integrity, http://www.teradyne.com/prods/tcs/products/connectors/mezzanine/hdm_stacker/signintegr, 3 pages.
Amphenol TCS(ATCS): VHDM L-Series Connector, http://www.teradyne.com/prods/tcs/products/connectors/backplane/vhdm__1-series/index.html, 2006, 4 pp.,.
Backplane Products Overview Page, http://www.molex.com/cgibin/bv/molex/superfamily/superfamily.jsp?BV_Session ID-@ 2005-2006© Molex, 4 pages.
Communications, Data, Consumer Division Mezzanine High-Speed High-Density Connectors GIG-ARRAY® and MEG-ARRAY® electrical Performance Data, 10 pages. FCI Corporation.
Fusi, M.A. et al., "Differential Signal Transmission through Backplanes and Connectors", Electronic Packaging and Production, Mar. 1996, 27-31.
Goel, R.P. et al., "AMP Z-Pack Interconnect System", 1990, AMP Incorporated, 9 pages.
HDM Separable Interface Detail, Molex®, 3 pages, date not available.
HDM/HDM *plus*, 2mm Backplane Interconnection System, Teradyne Connection Systems, ©1993, 22 pages.
HDM® HDM Plus® Connectors, http://www.teradyne.com/prods/tcs/products/connectors/backplane/hdm/index.html, 2006, 1 page.
Honda Connectors, "Honda High-Speed Backplane Connector NSP Series", Honda Tsushin Kogoyo Co., Ltd., Development Engineering Division, Tokyo , Japan, Feb. 7, 2003, 25 pages 2759 Only.
Hult, B., "FCI's Problem Solving Approach Changes Market, The FCI Electronics AirmMax VS®", ConnectorSupplier.com, Http://www.connectorsupplier.com/tech_;updates_FCI-Airmax_archive.htm, 2006,4 pages.
Metral® 2mm High-Speed Connectors, 1000, 2000, 3000 Series, Electrical Performance Data for Differential Applications, FCI Framatome Group, 2 pages, date not available.
Metral™, "Speed and Density Extensions", FCI, Jun. 3, 1999, 25 pages.
Nadolny, J. et al., "Optimizing Connector Selection for Gigabit Signal Speeds", ECN™, Sep. 1, 2000, http://www.ecnmag.com/article/CA45245, 6 pages.
NSP, Honda the World Famous Connectors, http://www.honda-connectors.co.jp, 2 pages, date not available.
Tyco Electronics, "Champ Z-Dok Connector System", Catalog # 1309281, Issued Jan. 2002, 3 pages.
Tyco Electronics/AMP, "Z-Dok and Z-Dok and Connectors", Application Specification # 11413068, Aug. 30, 2005, Revision A, 16 pages.
VHDM Daughterboard Connectors Feature press-fit Terminations and a Non-Stubbing Seperable Interface, ©Teradyne, Inc. Connections Systems Division, Oct. 8, 1997, 46 pages.
VHDM High-Speed Differential (VHDM HSD), date not available http://www.teradyne.com/prods/bps/vhdm/hsd.html, 6 pages.
GbX I-Trac Backplane Connector System, two pages., Printout from: http://www.molex.com/molex/family/intro.jsp?oid=-17461 &channe1=Products&familyOID=- 17461&frellink=lntroduction &chanName=family&pageTitle=GbX%201- Trac ™%20Backplane%20Connector%20System%201%200 yeryiew. Copyright 20052009.

Restriction Requirement for U.S. Appl. No. 11/924,002, dated Apr. 10, 2008.

Office Action for U.S. Appl. No. 11/924,002, dated Sep. 04, 2008.

Office Action for U.S. Appl. No. 11/924,002, dated Apr. 29, 2009.

First Notice of Allowance for U.S. Appl. No. 11/924,002, dated Feb. 24, 2009.

Second Notice of Allowance for U.S. Appl. No. 11/924,002, dated Sep. 10, 2009.

Amendment filed in U.S. Appl. No. 11/924,002 on Jul. 29, 2009.

Rce and Amendment filed in U.S. Appl. No. 11/924,002 on Mar. 10, 2009.

Amendment filed in U.S. Appl. No. 11/924,002 on Mar. 20, 2009.

Response/Election filed in U.S. Appl. No. 11/924,002 on May 12, 2008.

Restriction Requirement for U.S. Appl. No. 12/420,439 dated Sep. 30, 2009.

Response to Restriction Requirement for 12/420,439 dated Oct. 30, 2009.

* cited by examiner

BROADSIDE-COUPLED SIGNAL PAIR CONFIGURATIONS FOR ELECTRICAL CONNECTORS

CROSS-REFERENCE TO RELATED APPLICATIONS

This application claims benefit under 35 U.S.C. § 119(e) of provisional U.S. patent application Ser. No. 60/849,535, filed Oct. 5, 2006, the disclosure of which is incorporated herein by reference in its entirety.

BACKGROUND

An electrical connector may provide signal connections between electronic devices using signal contacts. The electrical connector may include a leadframe assembly that has a dielectric leadframe housing and a plurality of electrical contacts extending therethrough. Typically, the electrical contacts within a leadframe assembly are arranged into a linear array that extends along a direction along which the leadframe housing is elongated. The contacts may be arranged edge-to-edge along the direction along which the linear array extends. The electrical contacts in one or more leadframe assemblies may form differential signal pairs. A differential signal pair may consist of two contacts that carry a differential signal. The value, or amplitude, of the differential signal may be the difference between the individual voltages on each contact. The contacts that form the pair may be broadside-coupled (i.e., arranged such that the broadside of one contact faces the broadside of the other contact with which it forms the pair). Broadside or microstrip coupling is often desirable as a mechanism to control (e.g., minimize or eliminate) skew between the contacts that form the differential signal pair.

When designing a printed circuit board (PCB), circuit designers typically establish a desired differential impedance for the traces on the PCB that form differential signal pairs. Thus, it is usually desirable to maintain the same desired impedance between the differential signal contacts in the electrical connector, and to maintain a constant differential impedance profile along the lengths of the differential signal contacts from their mating ends to their mounting ends. It may further be desirable to minimize or eliminate insertion loss (i.e., a decrease in signal amplitude resulting from the insertion of the electrical connector into the signal's path). Insertion loss may be a function of the electrical connector's operating frequency. That is, insertion loss may be a greater at higher operating frequencies.

Therefore, a need exists for a high-speed electrical connector that minimizes insertion loss at higher operating frequencies while maintaining a desired differential impedance between differential signal contacts.

SUMMARY

The disclosed embodiments include an electrical connector having a first electrical contact and a second electrical contact adjacent to the first electrical contact. The first electrical contact may define a first broadside and a second broadside opposite the first broadside. The second electrical contact may define a third broadside and a fourth broadside opposite the third broadside. The electrical connector may further include a non-air dielectric and a commoned ground plate. The non-air dielectric may be disposed between the second broadside of the first electrical contact and the fourth broadside of the second electrical contact. The commoned ground plate and the first electrical contact may be adjacent to one another and may be separated by an air dielectric.

DETAILED DESCRIPTION

Figure 1B:
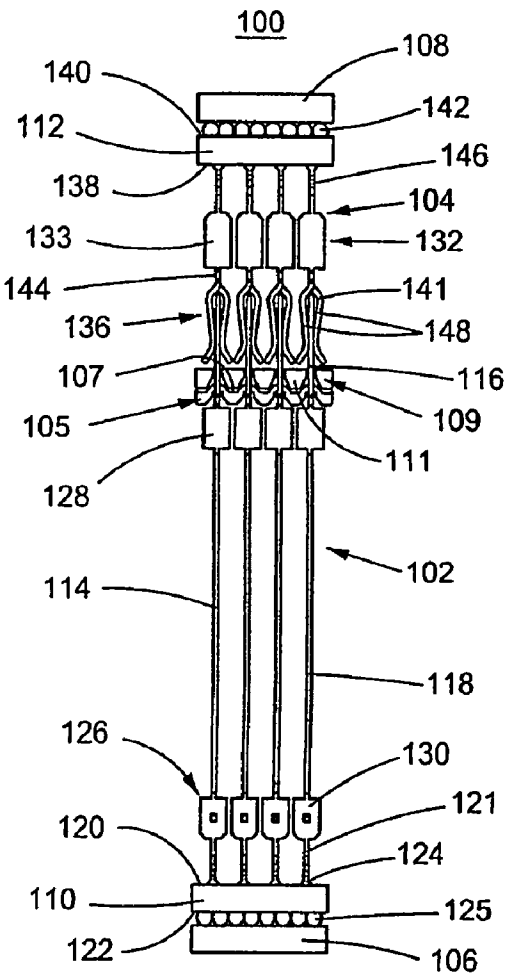
Fig. 1B PRIOR ART
FIGS. 1A and 1B depict a portion of a prior-art connector system, in isometric and side views, respectively.
Figure 1A:
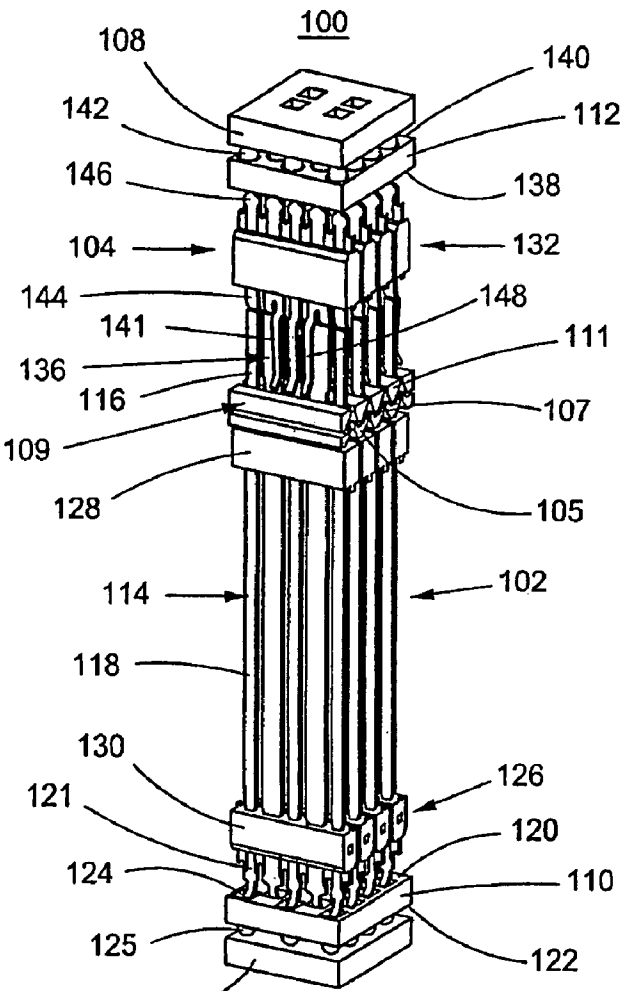
Fig. 1A PRIOR ART

FIGS. 1A and 1B depict isometric and side views, respectively, of a prior art connector system 100. The connector system 100 includes a plug connector 102 mated to a receptacle connector 104. The plug connector 102 may be mounted to a first substrate, such as a printed circuit board 106. The receptacle connector 104 may be mounted to a second substrate, such as a printed circuit board 108. The plug connector 102 and the receptacle connector 104 are shown as vertical connectors. That is, the plug connector 102 and the receptacle connector 104 each define mating planes that are generally parallel to their respective mounting planes.

The plug connector 102 may include a connector housing, a base 110, leadframe assemblies 126, and electrical contacts 114. The connector housing of the plug connector 102 may include an interface portion 105 that defines one or more grooves 107. As will be further discussed below, the grooves 107 may receive a portion of the receptacle connector 104 and, therefore, may help provide mechanical rigidity and support to the connector system 100.

Each of the leadframe assemblies 126 of the plug connector 102 may include a first leadframe housing 128 and a second leadframe housing 130. The first leadframe housing 128 and the second leadframe housing 130 may be made of a dielectric material, such as plastic, for example. The leadframe assemblies 126 may be insert molded leadframe assemblies (IMLAs) and may house a linear array of electrical contacts 114. For example, as will be further discussed below, the array of electrical contacts 114 may be arranged edge-to-edge in each lead frame assembly 126, i.e., the edges of adjacent electrical contacts 114 may face one another.

The electrical contacts 114 of the plug connector 102 may each have a cross-section that defines two opposing edges and two opposing broadsides. Each electrical contact 114 may also define at least three portions along its length. For example, as shown in FIG. 1B, each electrical contact 114 may define a mating end 116, a lead portion 118, and a terminal end 121. The mating end 116 may be blade-shaped, and may be received by a respective electrical contact 136 of the receptacle connector 104. The terminal end 121 may be "compliant" and, therefore, may be press-fit into an aperture 124 of the base 110. The terminal end 121 may electrically connect with a ball grid array (BGA) 125 on a substrate face 122 of the base 110. The lead portion 118 of the electrical contact 114 may extend from the terminal end 121 to the mating end 116.

The base 110 of the plug connector 102 may be made of a dielectric material, such as plastic, for example. The base 110 may define a plane having a connector face 120 and the substrate face 122. The plane defined by the base 110 may be generally parallel to a plane defined by the printed circuit board 106. As shown in FIG. 1A, the connector face 120 of the base 110 may define the apertures 124 that receive the terminal ends 121 of the electrical contacts 114. The substrate face 122 of the base 110 may include the BGA 125, which may electrically connect the electrical contacts 114 to the printed circuit board 106.

The receptacle connector 104 may include a connector housing, a base 112, leadframe assemblies 132, and electrical contacts 136. The connector housing of the receptacle connector 104 may include an interface portion 109 that defines one or more ridges 111. Upon mating the plug connector 102 and the receptacle connector 104, the ridges 111 on the connector housing of the receptacle connector 104 may engage with the grooves 107 on the connector housing of the plug connector 102. Thus, as noted above, the grooves 107 and the ridges 111 may provide mechanical rigidity and support to the connector system 100.

Each of the leadframe assemblies 132 of the receptacle connector 104 may include a leadframe housing 133. The leadframe housing 133 may be made of a dielectric material, such as plastic, for example. Each of the leadframe assemblies 132 may be an insert molded leadframe assembly (IMLAs) and may house a linear array of electrical contacts 136. For example, the array of electrical contacts 136 may be arranged edge-to-edge in the leadframe assembly 132, i.e., the edges of adjacent electrical contacts 136 may face one another.

Like the electrical contacts 114, the electrical contacts 136 of the receptacle connector 104 may have a cross-section that defines two opposing edges and two opposing broadsides. Each electrical contact 136 may define at least three portions along its length. For example, as shown in FIG. 1B, each electrical contact 136 may define a mating end 141, a lead portion 144, and a terminal end 146. The mating end 141 of the electrical contact 136 may be any receptacle for receiving a male contact, such as the blade-shaped mating end 116 of the electrical contact 114. For example, the mating end 141 may include at least two-opposing tines 148 that define a slot therebetween. The slot of the mating end 141 may receive the blade-shaped mating end 116 of the electrical contacts 114. The width of the slot (i.e., the distance between the opposing tines 148) may be smaller than the thickness of the blade-shaped mating end 116. Thus, the opposing tines 148 may exert a force on each side of the blade-shaped mating end 116, thereby retaining the mating end 116 of the of the electrical contact 114 in the mating end 142 of the electrical contact 136. Alternatively, as shown in FIG. 1A, the mating end 141 may include a single tine 148 that is configured to make contact with one side of the blade-shaped mating end 116.

The terminal end 146 of the electrical contact 136 may be "compliant" and, therefore, may be press-fit into an aperture (not shown) of the base 112. The terminal end 146 may electrically connect with a ball grid array (BGA) 142 on a substrate face 140 of the base 112. The lead portion 144 of each electrical contact 136 may extend from the terminal end 146 to the mating end 141.

The base 112 of the receptacle connector 104 may be made of a dielectric material, such as plastic, for example. The base 112 may define a plane having a connector face 138 and the substrate face 140. The plane defined by the base 112 may be generally parallel to a plane defined by the printed circuit board 108. The connector face 138 may define apertures (not shown) for receiving the terminal ends 146 of electrical contacts 136. Although the apertures of the base 112 are not shown in FIGS. 1A and 1B, the apertures in the connector face 138 of the base 112 may be the same or similar to the apertures 124 in the connector face 120 of the base 110. The substrate face 140 may include the BGA 142, which may electrically connect the electrical contacts 136 to the printed circuit board 108.

Figure 1C:
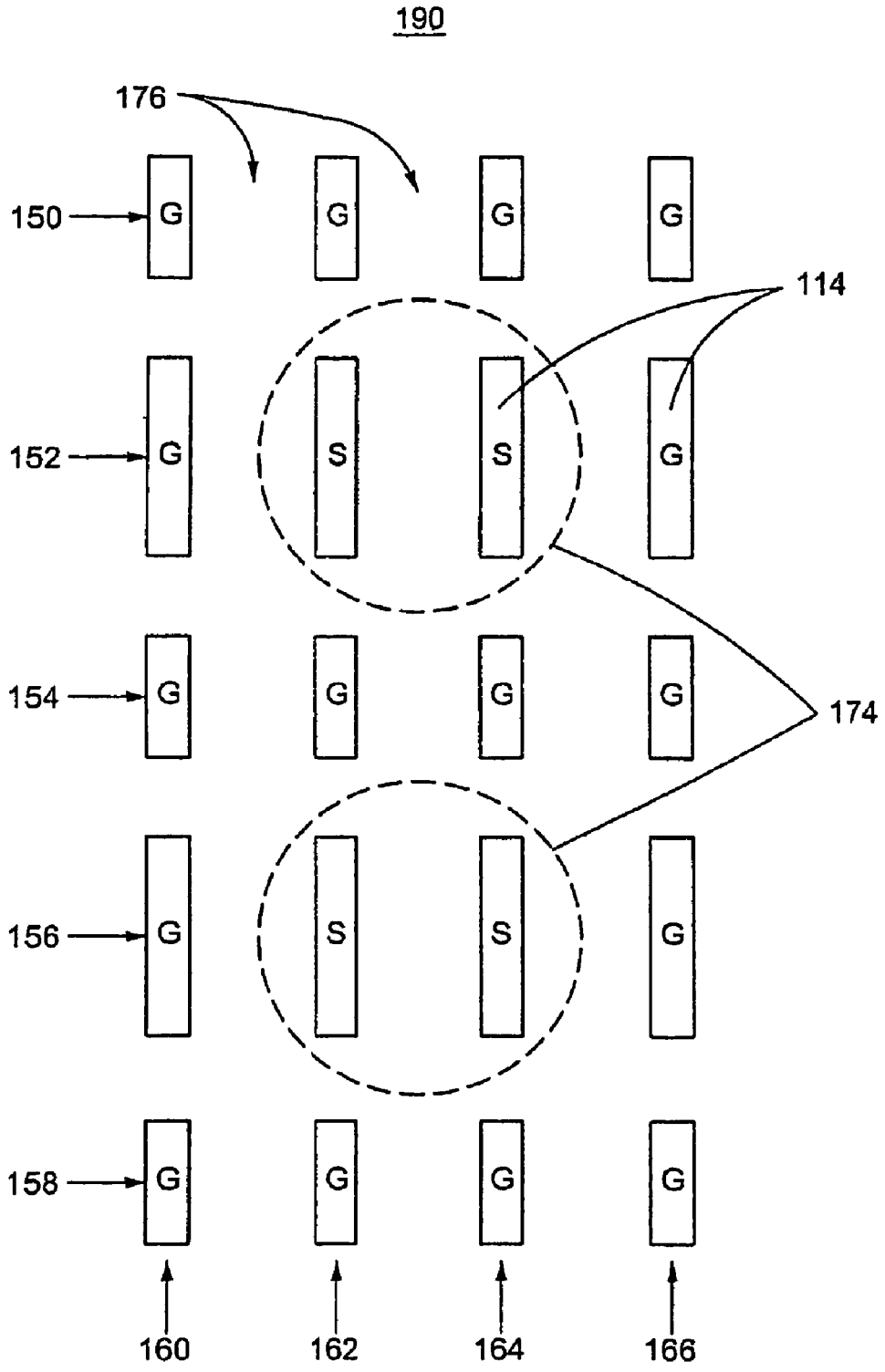
Fig. 1C PRIOR ART
FIG. 1C depicts a contact arrangement of the prior-art connector system shown in FIGS. 1A and 1B.

FIG. 1C depicts a contact arrangement 190, viewed from the face of the plug connector 102, in which the electrical contacts 114 are arranged in linear arrays. As shown in FIG. 1C, the electrical contacts 114 may be arranged in a 5×4 array, though it will be appreciated that the plug connector 102 may include any number of the electrical contacts 114 arranged in various configurations. As shown, the plug connector 102 may include contact rows 150, 152, 154, 156, 158 and contact columns 160, 162, 164, 166.

As noted above, each of the electrical contacts 114 may have a cross-section that defines two opposing edges and two opposing broadsides. The electrical contacts 114 may be arranged edge-to-edge along each of the columns 160, 162, 164, 166. In addition, the electrical contacts 114 maybe arranged broadside-to-broadside along each of the rows 150, 152, 154, 156, 158. As shown in FIG. 1C, the broadsides of the electrical contacts 114 in the rows 150, 154, 158 may be smaller than the broadsides of the electrical contacts 114 in the rows 152, 156. Each of the electrical contacts 114 may be surrounded on all sides by a dielectric 176, which may be air.

The electrical contacts 114 in the plug connector 102 may include ground contacts G and signal contacts S. As shown in FIG. 1C, the rows 150, 154, 158 of the plug connector 102 may include all ground contacts G. The rows 152, 156 of the plug connector 102 may include both ground contacts G and signal contacts S. For example, the electrical contacts 114 in the rows 152, 156 may be arranged in a G-S-S-G pattern. As noted above, the electrical contacts 114 may be arranged broadside-to-broadside along each of the rows 150, 152, 154, 156, 158. Accordingly, adjacent signal contacts S in rows 152, 156 may form broadside coupled differential signal pairs, such as the differential signal pairs 174 shown in FIG. 1C.

Figure 2B:
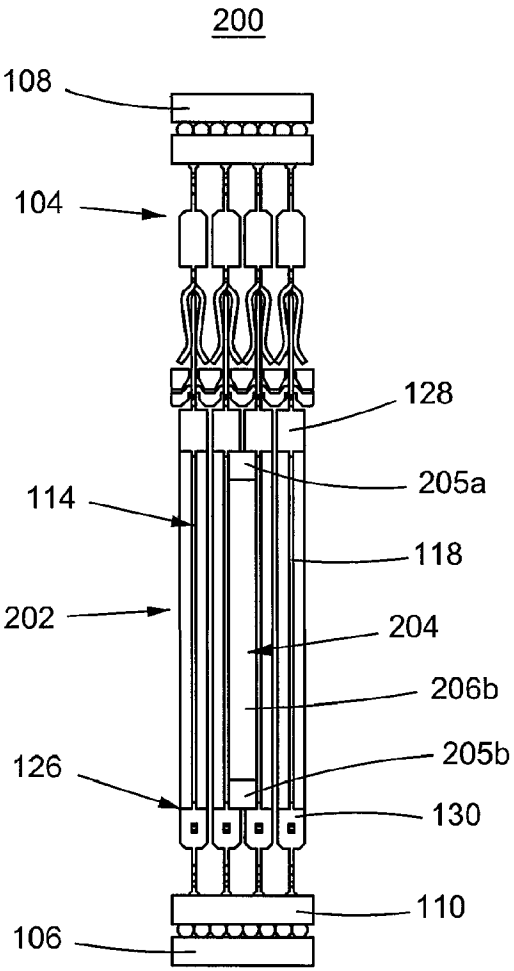
FIGS. 2A and 2B depict a portion of a connector system, in isometric and side views, respectively, according to an embodiment.
Figure 2A:
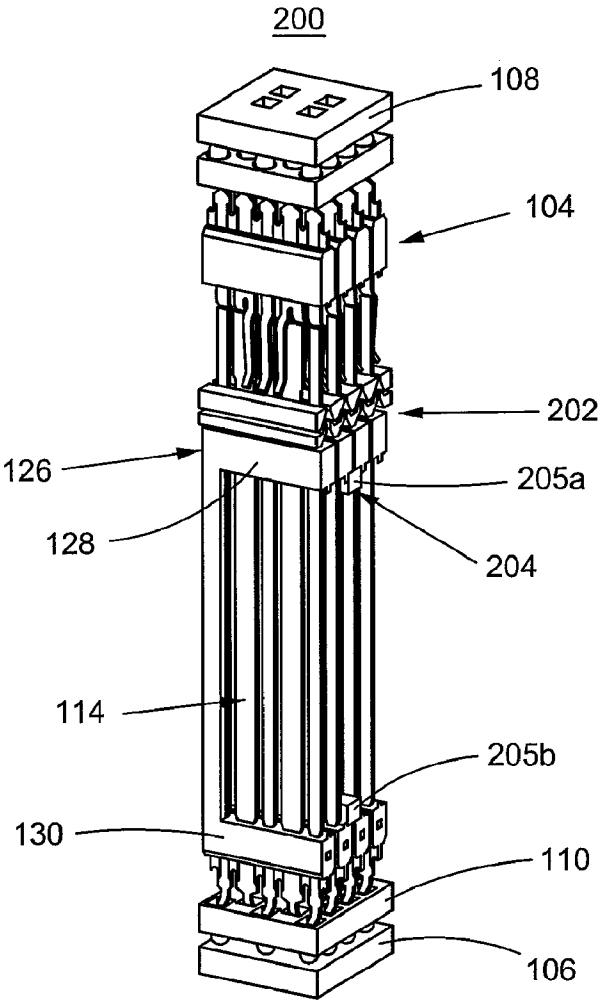

FIGS. 2A and 2B depict isometric and side views, respectively, of a connector system 200 according to an embodiment. The connector system 200 may include a plug connector 202 mated to the receptacle connector 104. The plug connector 202 may be mounted to the printed circuit board 106. The receptacle connector 104 may be mounted to the printed circuit board 108. The plug connector 202 and the receptacle connector 104 are shown as vertical connectors. However, it will be appreciated that either or both of the plug connector 202 and the receptacle connector 104 may be right-angle connectors in alternative embodiments.

The plug connector 202 may include the base 110, leadframe assemblies 126, and electrical contacts 114. As shown in FIG. 2B, the plug connector 202 may further include a non-air dielectric, such as a dielectric material 204, positioned between adjacent leadframe assemblies 126. In particular, the dielectric material 204 may be positioned between the adjacent leadframe assemblies that house one or more signal contacts S. The dielectric material 204 may be made from any suitable material, such as plastic, for example. The dielectric material 204 may be molded as part of the leadframe assemblies 126. Alternatively, the dielectric material 204 may be molded independent of the leadframe assemblies 126 and subsequently inserted therebetween.

Figure 2C:
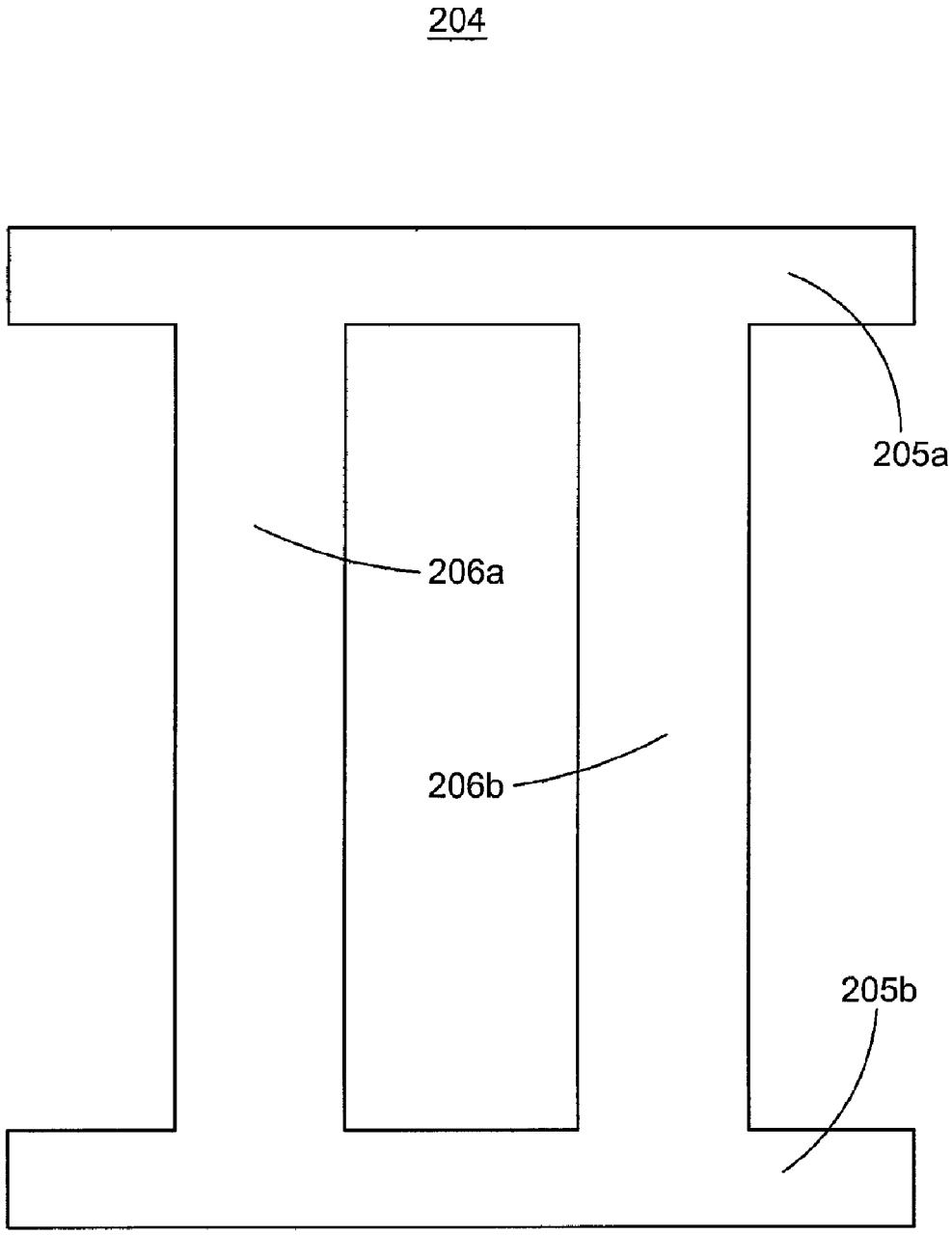
FIG. 2C depicts an example dielectric material that may be disposed between leadframe assemblies of a plug connector shown in FIGS. 2A and 2B.

FIG. 2C depicts a side view of the dielectric material 204. As shown in FIG. 2C, the dielectric material 204 may include header portions 205*a*, 205*b*, that extend substantially parallel to one another. The dielectric material may further include interconnecting portions 206*a*, 206*b* that extend substantially parallel to one another and substantially perpendicular to the header portions 205*a*, 205*b*. The interconnecting portions 206*a*, 206*b* may connect the header portion 205*a* to the header portion 205*b*.

As noted above with respect to FIGS. 2A and 2B, the dielectric material 204 may be disposed between adjacent leadframe assemblies 126 having signal contacts S (i.e., the inner leadframe assemblies 126 shown in FIGS. 2A and 2B). More specifically, the header portion 205*a* of the dielectric material 204 may be adjacent to the first leadframe housing 128 and may extend along a length thereof. The header portion 205*b* of the dielectric material 204 may be adjacent to the second leadframe housing 130 and may extend along a length thereof. Thus, the header portions 205*a*, 205*b* may be disposed adjacent to at least a portion of each electrical contact 114 in the inner leadframe assemblies 126. The interconnecting portions 206*a*, 206*b* of the dielectric material 204 may extend substantially parallel to the electrical contacts 114 in the inner leadframe assemblies 126. In particular, as will be further discussed below, the interconnecting portions 206*a*, 206*b* may extend along the lengths of each signal contact housed in the inner leadframe assemblies 126.

Figure 2D:
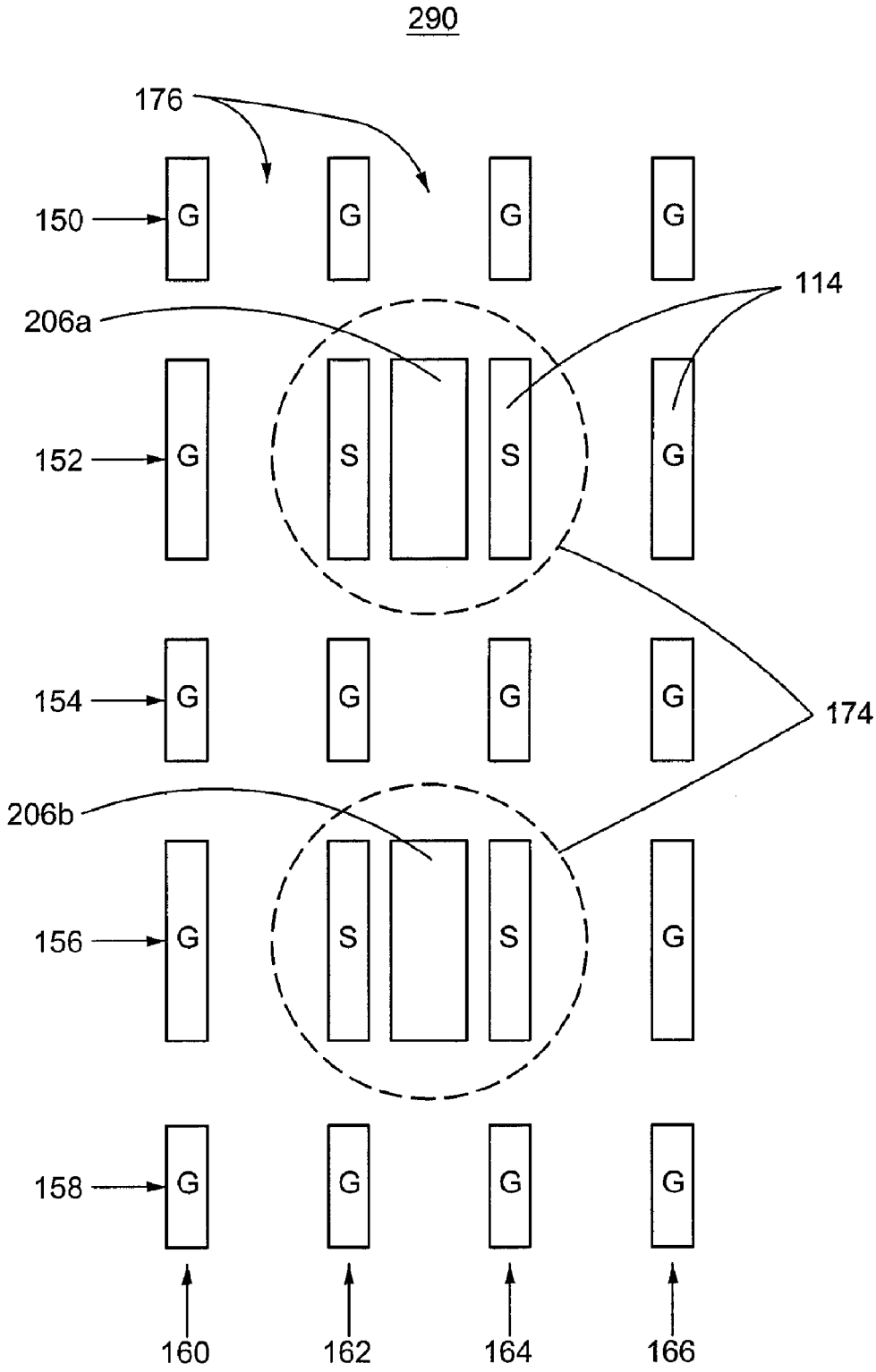
FIG. 2D depicts an example contact arrangement of the plug connector shown in FIGS. 2A and 2B.

FIG. 2D depicts a contact arrangement 290, viewed from the face of the plug connector 202, that includes the linear arrays of electrical contacts 114 and a portion of the dielectric material 204. Like the contact arrangement depicted in FIG. 1C, the electrical contacts 114 may be arranged in a 5×4 array and may define contact rows 150, 152, 154, 156, 158 and contact columns 160, 162, 164, 166. The electrical contacts 114 in the plug connector 202 may have a cross-section that defines two opposing edges and two opposing broadsides. The electrical contacts 114 may be arranged edge-to-edge along each of the columns 160, 162, 164, 166. In addition, the electrical contacts 114 may be arranged broadside-to-broadside along each of the rows 150, 152, 154, 156, 158. The broadsides of the electrical contacts 114 in the rows 150, 154, 158 may be smaller than the broadsides of the electrical contacts 114 in the rows 152, 156.

The electrical contacts 114 in the plug connector 202 may also include ground contacts G and signal contacts S. The rows 150, 154, 158 of the plug connector 202 may include all ground contacts G, and the rows 152, 156 may include both ground contacts G and signal contacts S. For example, the electrical contacts 114 in the rows 152, 156 may be arranged in a G-S-S-G pattern. The electrical contacts 114 may be arranged broadside-to-broadside along each of the rows 150, 152, 154, 156, 158. Accordingly, adjacent signal contacts S in rows 152, 156 may form broadside coupled differential signal pairs 174.

As shown in FIG. 2D, the interconnecting portions 206*a*, 206*b* of the dielectric material 204 may define a generally rectangular cross-section and may be positioned between adjacent signal contacts S in the columns 162, 164. That is, the interconnecting portions 206*a*, 206*b* may be positioned between the signal contacts S of each broadside-coupled differential signal pair 174 in the plug connector 202. In addition, each of the electrical contacts 114 may be surrounded on all sides by the dielectric 176, which may be different than the dielectric material 204 disposed between the broadside-coupled differential signal pairs 174.

As further shown in FIG. 2D, the interconnecting portions 206*a*, 206*b* may extend a greater distance than each of the electrical contacts 114 in the direction of the rows 150, 152, 154, 156, 158 (i.e., the interconnecting portions 206*a*, 206*b* may be wider than the electrical contacts 114), though it will be appreciated that the widths of the interconnecting portions 206*a*, 206*b* may be equal to or less than the widths of the electrical contacts 114 in other embodiments. In addition, the interconnecting portions 206*a*, 206*b* may extend substantially the same distance as each of the electrical contacts 114 in the direction of the contact columns 160, 162, 164, 166 (i.e., the height of each of the interconnecting portions 206*a*, 206*b* may be substantially the same as the heights of the electrical contacts 114 in the contact rows 152, 156), though it will be appreciated that the heights of the interconnecting portions 206*a*, 206*b* may be greater than or less than the heights of the electrical contacts 114 in other embodiments.

Figure 3B:
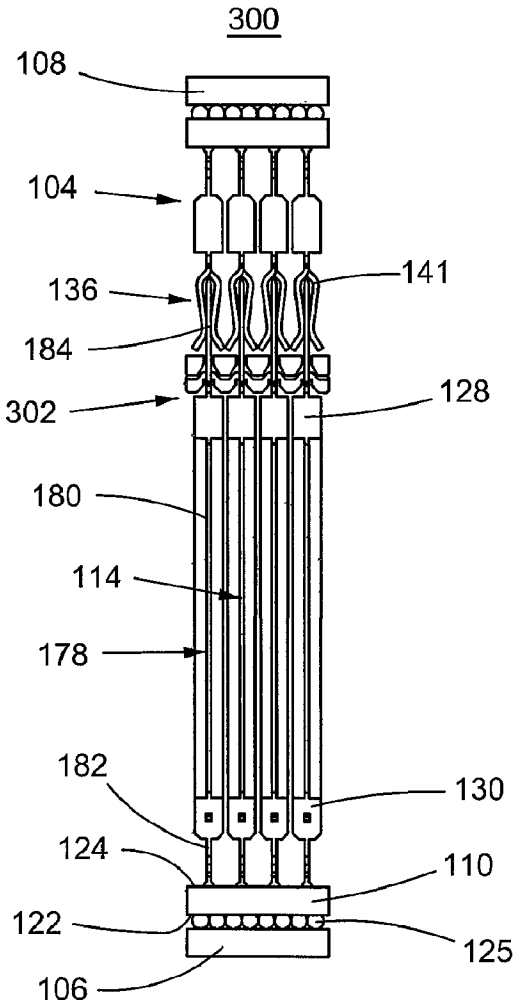
FIGS. 3A and 3B depict a portion of a connector system, in isometric and side views, respectively, according to another embodiment.
Figure 3A:
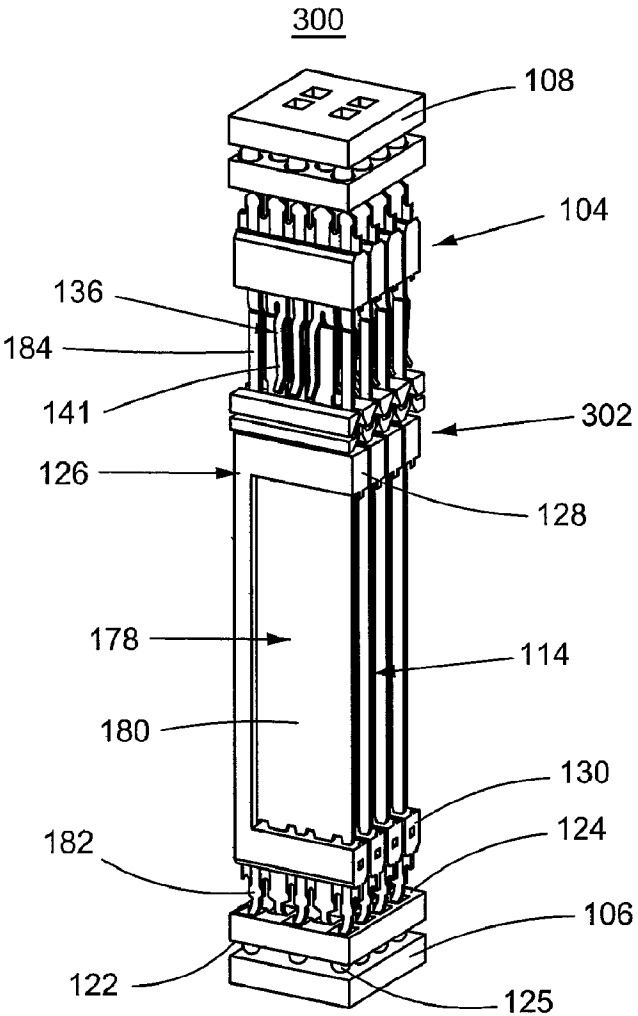

FIGS. 3A and 3B depict isometric and side views, respectively, of a connector system 300 according to another embodiment. The connector system 300 includes a plug connector 302 mated to the receptacle connector 104. The plug connector 302 may be mounted to the printed circuit board 106. The receptacle connector 104 may be mounted to the printed circuit board 108. The plug connector 302 and the receptacle connector 104 are shown as vertical connectors. However, it will be appreciated that either or both of the plug connector 302 and the receptacle connector 104 may be right-angle connectors in alternative embodiments.

The plug connector 302 may include the base 110, leadframe assemblies 126, and electrical contacts 114. As shown in FIG. 3A, the plug connector 302 may further include a commoned ground plate 178 housed in at least one of the leadframe assemblies 126. The commoned ground plate 178 may be a continuous, electrically conductive sheet that extends along an entire contact column and that is brought to ground, thereby shielding all electrical contacts 114 adjacent to the commoned ground plate 178. The commoned ground plate 178 may include a plate portion 180, terminal ends 182, and mating interfaces 184.

More specifically, the plate portion 180 of the commoned ground plate 178 may be housed within the leadframe assembly 126, and may extend from the terminal ends 182 to the mating interfaces 184. As shown in FIG. 3A, the commoned ground plate 178 may include terminal ends 182 extending from the plate portion 180, and extending from the second leadframe housing 130 of the leadframe assembly 126. The terminal ends 182 may be compliant and may, therefore, be press-fit into the apertures 124 of the base 110. The terminal ends 182 of the commoned ground plate 178 may electrically connect with the BGA 125 on the bottom side 122 of the base 110.

The commoned ground plate 178 may also include mating interfaces 184 extending from the plate portion 180, and extending above the first leadframe housing 128 of the lead frame assembly 126. The mating interfaces 184 may be blade-shaped, and may be received by the respective mating ends 141 of the electrical contacts 136.

Figure 3C:
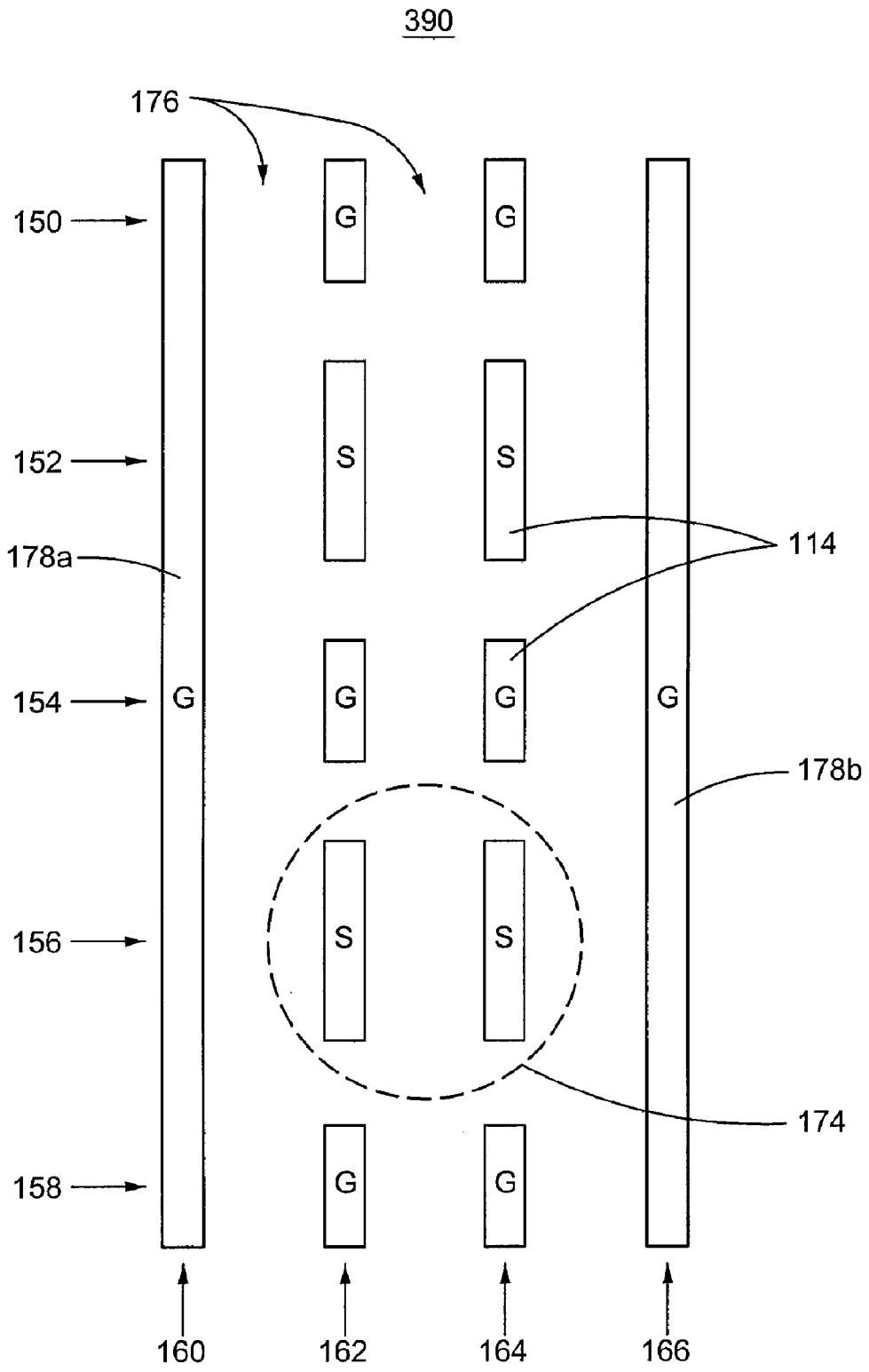
FIG. 3C depicts an example contact arrangement of a plug connector shown in FIGS. 3A and 3B.

FIG. 3C depicts a contact arrangement 390, viewed from the face of the plug connector 302, that includes linear arrays of electrical contacts 114 and commoned ground plates 178*a*, 178*b*. The electrical contacts 114 and the commoned ground plates 178*a*, 178*b* may be arranged in a 5×4 array and may define contact rows 150, 152, 154, 156, 158 and contact columns 160, 162, 164, 166. Like the contact arrangement depicted in FIG. 1C, the electrical contacts 114 in the plug connector 302 may have a cross-section that defines two opposing edges and two opposing broadsides. The electrical contacts 114 may be arranged edge-to-edge along each of the columns 162, 164. In addition, the electrical contacts 114 may be arranged broadside-to-broadside along each of the rows 150, 152, 154, 156, 158. The broadsides of the electrical contacts 114 in the rows 150, 154, 158 may be smaller than the broadsides of the electrical contacts 114 in the rows 152, 156.

The commoned ground plates 178*a*, 178*b* may be positioned adjacent to the contact columns 162, 164, respectively. Thus, as shown in FIG. 3C, the commoned ground plates 178*a*, 178*c* may replace the ground contacts G in the contact columns 160, 166 shown in FIG. 1C.

The electrical contacts 114 in the plug connector 302 may include ground contacts G and signal contacts S. The rows 150, 154, 158 of the plug connector 302 may include all ground contacts G, and the rows 152, 156 may include both ground contacts G and signal contacts S. For example, the commoned ground plates 178*a*, 178*b* and the electrical contacts 114 in the rows 152, 156 may be arranged in a G-S-S-G pattern. The electrical contacts 114 may be arranged broadside-to-broadside along each of the rows 150, 152, 154, 156, 158. Accordingly, adjacent signal contacts S in rows 152, 156 may form broadside coupled differential signal pairs 174.

The commoned ground plates 178*a*, 178*b* may each have a cross-section that is generally rectangular in shape. As shown in FIG. 3C, the commoned ground plates 178*a*, 178*b* may each extend substantially the entire length of the contact columns 160, 162, 164, 166. The commoned ground plates 178*a*, 178*b* may also extend substantially the same distance as each of the electrical contacts 114 in the direction of the contact rows (i.e., each of the commoned ground plates 178*a*, 178*b* may have substantially the same width as the electrical contacts 114), though it will be appreciated that the widths of the commoned ground plates 178*a*, 178*b* may be less than or greater than the widths of the electrical contacts 114 in other embodiments. The electrical contacts 114 and the commoned ground plates 178*a*, 178*b* may be surrounded on all sides by the dielectric 176.

Figure 4B:
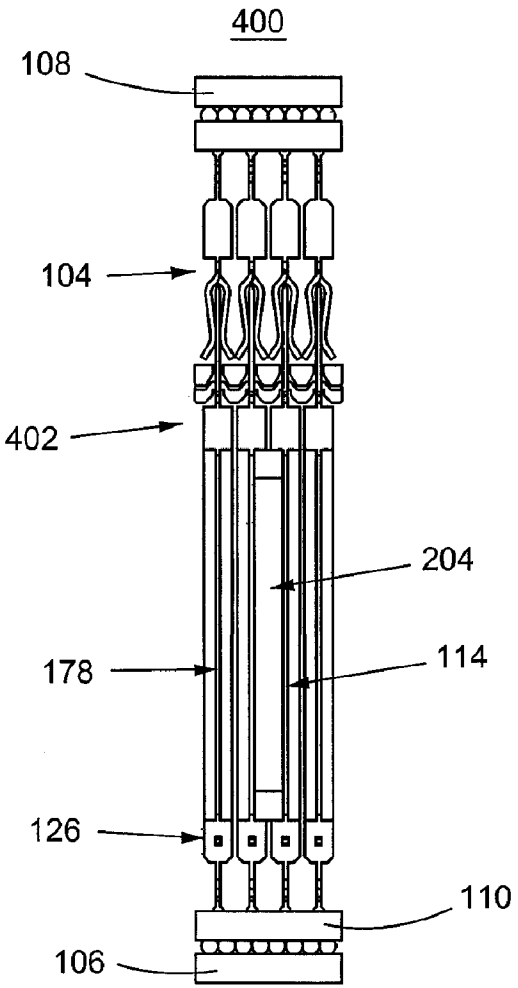
FIGS. 4A and 4B depict a portion of a connector system, in isometric and side views, respectively, according to yet another embodiment.
Figure 4A:
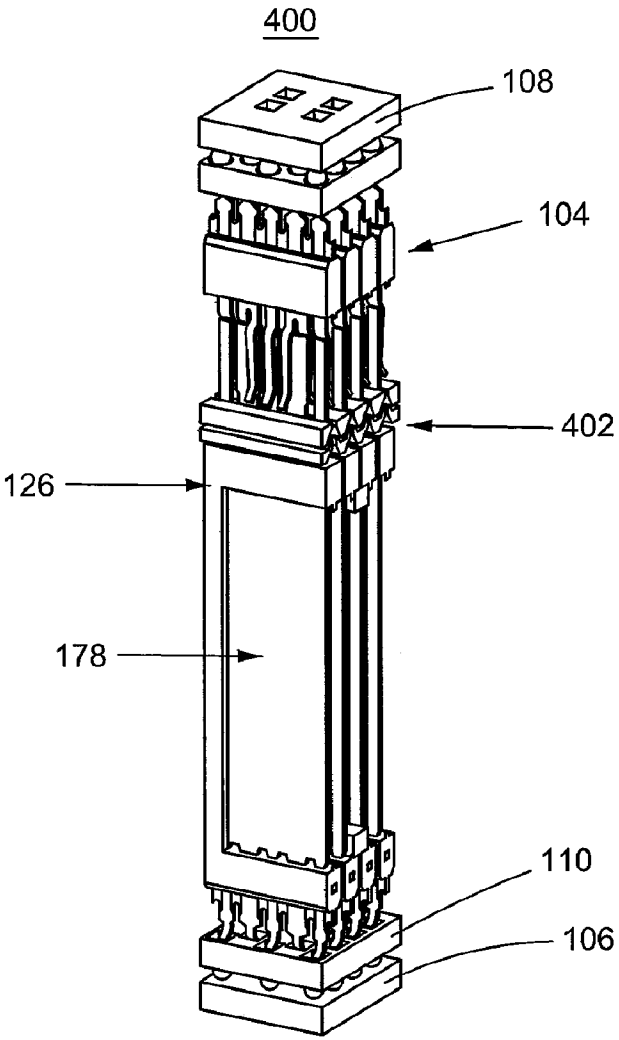

FIGS. 4A and 4B depict isometric and side views, respectively, of a connector system 400 according to yet another embodiment. The connector system 400 may include a plug connector 402 mated to the receptacle connector 104. The plug connector 402 may be mounted to the printed circuit board 106. The receptacle connector 104 may be mounted to the printed circuit board 108. The plug connector 402 and the receptacle connector 104 are shown as vertical connectors. However, either or both of the plug connector 402 and the receptacle connector 104 may be right-angle connectors in alternative embodiments. The plug connector 402 may include the base 110, the leadframe assemblies 126, the electrical contacts 114, the commoned ground plates 178*a*, 178*b*, and the dielectric material 204.

Figure 4C:
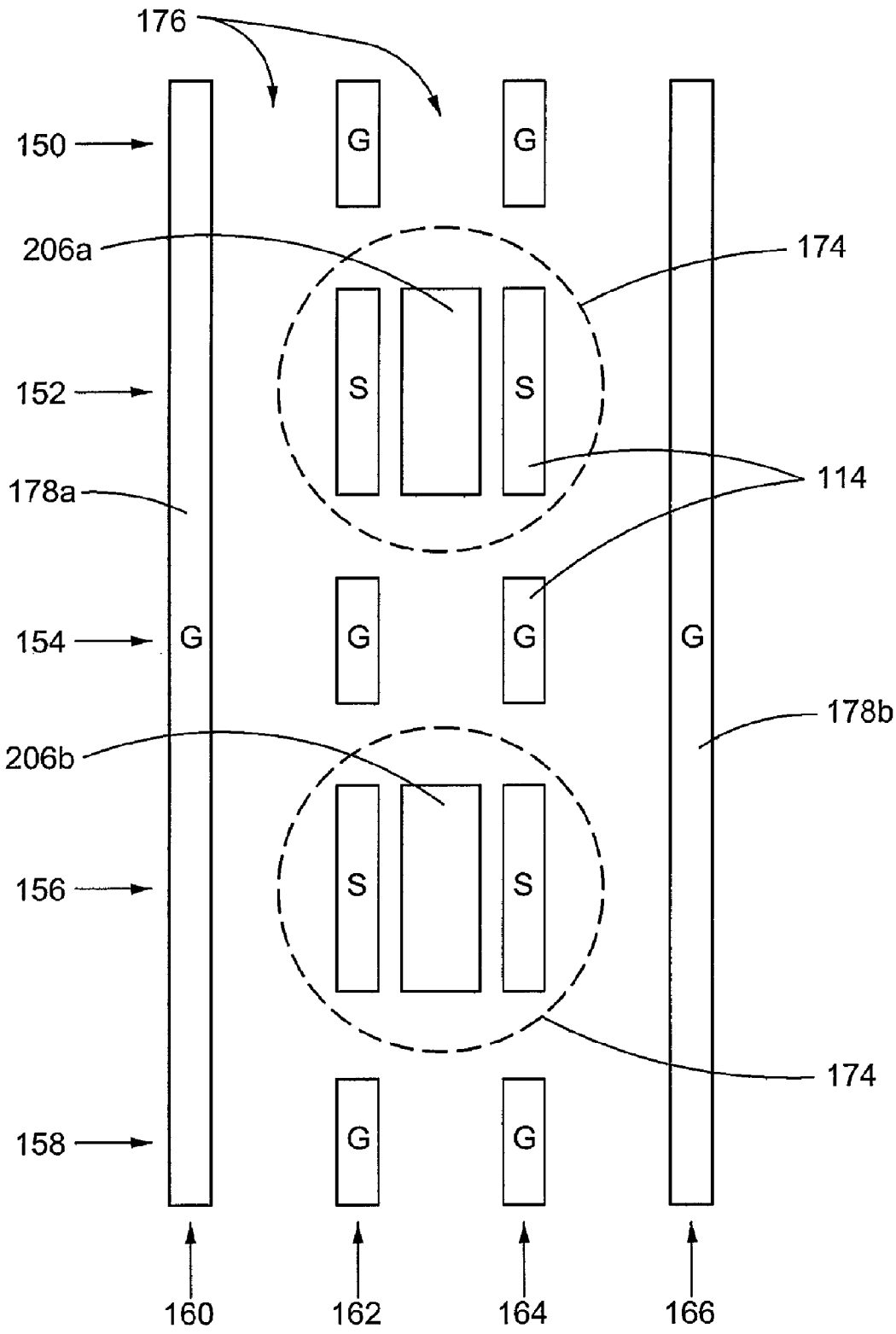
FIG. 4C depict an example contact arrangement of a plug connector shown in FIGS. 4A and 4B.

FIG. 4C depicts a contact arrangement 490, viewed from the face of the plug connector 402, that includes linear arrays of electrical contacts 114, the commoned ground plates 178*a*, 178*b* and the dielectric material 204. As shown in FIG. 4C, the interconnecting portions 206*a*, 206*b* of the dielectric material 204 may define a generally rectangular cross-section and may be positioned between the signal contacts S in the contact columns 162, 164. That is, the interconnecting portions 206*a*, 206*b* may be positioned between the broadside-coupled differential signal pairs 174 in the contact columns 162, 164. In addition, each of the electrical contacts 114 and the commoned ground plates 178*a*, 178*b* may be surrounded on all sides by the dielectric 176, which may be different than the dielectric material 204 disposed between the broadside-coupled differential signal pairs 174.

As further shown in FIG. 4C, the commoned ground plates 178*a*, 178*b* may be positioned adjacent to the contact columns 162, 164, respectively. Thus, the commoned ground plates 178*a*, 178*b* may replace the ground contacts G in the contact columns 160, 166 shown in FIG. 1C. The commoned ground plates 178*a*, 178*b* may each have a cross-section that is generally rectangular in shape. As shown in FIG. 4C, the commoned ground plates 178*a*, 178*b* may each extend substantially the entire length of the contact columns 160, 162, 164, 166. The commoned ground plates 178*a*, 178*b* may also extend substantially the same distance as each of the electrical contacts 114 in the direction of the contact rows (i.e., each of the commoned ground plates 178*a*, 178*b* may have the same width as the electrical contacts 114), though it will be appreciated that the widths of the of the commoned ground plates 178*a*, 178*b* may be less than or greater than the widths of the electrical contacts 114 in other embodiments.

It has also been found that embodiments as described herein break up the coupling wave that moves up the connector causing an insertion loss "suck out" about the 4 GHz region. An object of the dielectric material 204 is to change the impedance slightly between signal and ground to minimize the coupling wave and the insertion loss suck out associated therewith. The ground plane is to minimize the signal pair coupling to the ground individual pin edge and to provide a continuous ground plane.

What is claimed:

1. An electrical connector comprising:

a first electrical contact;

a second electrical contact adjacent to the first electrical contact;

a non-air dielectric disposed between the first and second electrical contacts; and a commoned ground plate adjacent to the first electrical contact, wherein the commoned ground plate and the first electrical contact are separated by an air dielectric, wherein the first electrical contact is housed in a first insert-molded leadframe assembly (IMLA), the second electrical contact is housed in a second IMLA, and the non-air dielectric is a separate structure from the first and second IMLAs.

2. The electrical connector of claim 1, wherein the first and second electrical contacts are differential signal pairs.

3. The electrical connector of claim 1 further comprising a second commoned ground plate adjacent to the second electrical contact, wherein the second commoned ground plate and the second electrical contact are separated by the air dielectric.

4. The electrical connector of claim 1, wherein the first electrical contact defines a first broadside and a second broadside opposite the first broadside, the second electrical contact defines a third broadside and a fourth broadside opposite the third broadside, and the non-air dielectric is disposed between the second and fourth broadsides.

5. The electrical connector of claim 4, wherein the commoned ground plate is disposed adjacent to the first broadside of the first electrical contact.

6. The electrical connector as recited in claim 5, wherein the commoned ground plate is housed in a third IMLA.

7. An electrical connector comprising:

a first linear array of electrical contacts comprising a first electrical contact, a second electrical contact, and a first ground contact disposed between the first and second electrical contacts;

a second linear array of electrical contacts adjacent to the first linear array of electrical contacts, the second linear array of electrical contacts comprising a third electrical contact, a fourth electrical contact, and a second ground contact disposed between the third and fourth electrical contacts, wherein the first and third electrical contacts are arranged broadside-to-broadside and form a first pair of differential signal contacts, and wherein the second and fourth electrical contacts are arranged broadside-to-broadside and form a second pair of differential signal contacts;

a non-air dielectric disposed between the broadsides of the first pair of differential signal contacts and between the broadsides of the second pair of differential signal contacts; and a first commoned ground plate disposed adjacent to the first linear array of electrical contacts, wherein the first commoned ground plate is separated from the first linear array of electrical contacts by an air dielectric.

8. The electrical connector of claim 7, wherein the first and second ground contacts are arranged broadside-to-broadside and are separated by the air dielectric.

9. The electrical connector of claim 8, wherein the broadsides of the first, second, third and fourth electrical contacts are greater than the broadsides of the first and second ground contacts.

10. The electrical connector of claim 7, wherein the first linear array of electrical contacts is housed in a first insert-molded leadframe assembly (IMLA), the second linear array of electrical contacts is housed in a second IMLA, and the commoned ground plate is housed in a third IMLA.

11. The electrical connector of claim 7 further comprising a second commoned ground plate disposed adjacent to the second linear array of electrical contacts, wherein the second commoned ground plate is separated from the second linear array of electrical contacts by the air dielectric.

12. The electrical connector of claim 7, wherein the commoned ground plate comprises a plurality of terminal ends.

13. The electrical connector of claim 7, wherein the first and second ground contacts are not electrically connected to each other.

14. The electrical connector of claim 13 further comprising:

a first ground contact defining a fifth broadside and a sixth broadside opposite the fifth broadside; and a second ground contact adjacent to the first ground contact, the second ground contact defining a seventh broadside and an eighth broadside opposite the seventh broadside, wherein the first ground contact is adjacent to an edge of the first electrical contact and the second ground contact is adjacent to an edge of the second electrical contact, and wherein the first and second ground contacts are separated by the air dielectric.

15. The electrical connector of claim 14, wherein the broadsides of the first and second electrical contacts are greater than the broadsides of the first and second ground contacts.

16. An electrical connector comprising:

a first leadframe assembly comprising a first leadframe housing and a first electrical contact extending through the first leadframe housing;

a second leadframe assembly adjacent to the first leadframe assembly, the second leadframe assembly comprising a second leadframe housing and a second electrical contact extending through the second leadframe housing, wherein the first and second electrical contacts are arranged broadside-to-broadside;

a dielectric insert disposed between the first and second leadframe assemblies, wherein a portion of the dielectric insert is positioned between the broadsides of the first and second electrical contacts; and a third leadframe assembly adjacent to the first lead frame assembly, the third lead frame assembly comprising a third leadframe housing and a commoned ground plate extending through the third leadframe housing, wherein the commoned ground plate and the first electrical contact are separated by an air dielectric.

17. The electrical connector of claim 16, wherein the first and second electrical contacts define differential signal contacts.

18. The electrical connector of claim 17, wherein the commoned ground plate includes a plurality of terminal ends adapted to terminate to a printed circuit board.

19. The electrical connector of claim 17, wherein the commoned ground plate further defines a plurality of mating interfaces that are adapted to be received in a respective receptacle connector.

20. The electrical connector of claim 17, wherein the first leadframe assembly further comprises a first ground contact extending through the first leadframe housing, wherein the second leadframe assembly further comprises a second ground contact extending through the second leadframe housing, and wherein the first and second ground contacts are arranged broadside-to-broadside and are separated by the air dielectric.

21. An electrical connector comprising:

a first electrical contact of a differential signal pair defining a first broadside and a second broadside opposite the first broadside;

a second electrical contact of the differential signal pair adjacent to the first electrical contact, the second electrical contact defining a third broadside and a fourth broadside opposite the third broadside; and a non-air dielectric disposed between the second and fourth broadsides and configured to be disposed between the first and second electrical contacts, the non-air dielectric extending along a length of the first electrical contact and a length of the second electrical contact, wherein the non-air dielectric disposed between the first and second electrical contacts is configured to reduce insertion loss suck out in the differential signal pair.

22. The electrical connector of claim 21 further comprising a commoned ground plate adjacent to the first broadside of the first electrical contact, wherein the commoned ground plate and the first electrical contact are separated by an air dielectric.

23. An electrical connector comprising:

a first electrical contact defining a first broadside and a second broadside opposite the first broadside;

a second electrical contact adjacent to the first electrical contact, the second electrical contact defining a third broadside and a fourth broadside opposite the third broadside;

a non-air dielectric disposed between the second and fourth broadsides and extending along a length of the first electrical contact and a length of the second electrical contact, wherein the non-air dielectric disposed between the first and second electrical contacts is configured to reduce insertion loss suck out; and a commoned ground plate adjacent to the first broadside of the first electrical contact, such that the commoned ground plate and the first electrical contact are separated by an air dielectric.

* * * * *